US008851148B2

(12) United States Patent
Lin

(10) Patent No.: US 8,851,148 B2
(45) Date of Patent: Oct. 7, 2014

(54) WINDOW BLIND

(71) Applicant: Shih-Ming Lin, Chiayi Hsien (TW)

(72) Inventor: Shih-Ming Lin, Chiayi Hsien (TW)

(73) Assignee: Shih-Ming Lin, Chiayi Hsien (TW)

( * ) Notice: Subject to any disclaimer, the term of this patent is extended or adjusted under 35 U.S.C. 154(b) by 0 days.

(21) Appl. No.: 13/774,337

(22) Filed: Feb. 22, 2013

(65) Prior Publication Data

US 2014/0238624 A1 Aug. 28, 2014

(51) Int. Cl.
*E06B 9/56* (2006.01)
*E06B 9/40* (2006.01)
*E06B 9/80* (2006.01)

(52) U.S. Cl.
CPC .... *E06B 9/40* (2013.01); *E06B 9/80* (2013.01)
USPC ..... 160/291; 160/178.1 R; 160/174 R; 160/168.1 R

(58) Field of Classification Search
CPC ..... E06B 9/76; E06B 9/322
USPC ..... 160/291, 314, 319, 320, 309, 174 R, 160/176.1 R, 178.1 R, 168.1 R, 173 R, 340
See application file for complete search history.

(56) References Cited

U.S. PATENT DOCUMENTS 2,815,179 A * 12/1957 Keljik ..... 242/389
3,194,366 A * 7/1965 Hensel ..... 192/223.2
3,653,777 A * 4/1972 Bross ..... 401/110
4,335,775 A * 6/1982 Frentzel et al. ..... 160/177 V
4,422,493 A * 12/1983 Forquer ..... 160/133
4,456,049 A * 6/1984 Vecchiarelli ..... 160/176.1 R
4,503,899 A * 3/1985 Forquer ..... 160/133
5,092,387 A * 3/1992 King et al. ..... 160/176.1 R
5,472,035 A * 12/1995 Biba et al. ..... 160/168.1 R
5,553,649 A * 9/1996 Chisaka et al. ..... 160/168.1 R
5,603,371 A * 2/1997 Gregg ..... 160/176.1 P
5,749,405 A * 5/1998 Huang ..... 160/168.1 R
5,845,695 A * 12/1998 Cadorette et al. ..... 160/173 V
5,850,863 A * 12/1998 Huang ..... 160/168.1 R
6,196,293 B1 * 3/2001 Lee ..... 160/168.1 V (Continued)

FOREIGN PATENT DOCUMENTS

CA 2437775 C * 12/2006
DE 202008007123 U1 9/2008

(Continued)

OTHER PUBLICATIONS

Extended European Search Report, dated Jul. 17, 2013, 5 pages.

*Primary Examiner* — Katherine Mitchell
*Assistant Examiner* — Johnnie A Shablack
(74) *Attorney, Agent, or Firm* — Schwabe Williamson & Wyatt PC

(57) ABSTRACT

A window blind includes a stationary seat, a blind mechanism, a coupling mechanism and a control pole. The blind mechanism includes a linking rod mounted to the stationary seat and a blind unit wound on the linking rod. The coupling mechanism includes a transmission unit connected to the linking rod and movable between an operable state and a non-operable state, a stop unit for restraining rotation of the linking rod when the transmission unit is at the non-operable state, and a resilient member for biasing the transmission unit toward the non-operable state. The control pole is connected to the transmission unit and is operable for converting the transmission unit to the operable state against a resilient force of the resilient member.

4 Claims, 11 Drawing Sheets

(56) References Cited

U.S. PATENT DOCUMENTS

| | | | | |
|---|---|---|---|---|
| 6,453,975 | B2 * | 9/2002 | Miller | 160/315 |
| 6,786,270 | B2 * | 9/2004 | Wen et al. | 160/170 |
| 6,910,516 | B2 * | 6/2005 | Huang | 160/170 |
| 6,973,952 | B2 * | 12/2005 | Nien | 160/170 |
| 7,204,292 | B2 * | 4/2007 | Nien | 160/168.1 R |
| 7,581,579 | B2 * | 9/2009 | McCormick et al. | 160/309 |
| 8,091,606 | B2 * | 1/2012 | Nien et al. | 160/176.1 R |
| 8,205,658 | B1 * | 6/2012 | Lin | 160/320 |
| 8,522,854 | B2 * | 9/2013 | Lin | 160/309 |
| 2002/0062931 | A1 * | 5/2002 | Allsopp | 160/168.1 R |
| 2004/0103995 | A1 * | 6/2004 | Nien | 160/170 |
| 2004/0200582 | A1 * | 10/2004 | Nien | 160/176.1 R |
| 2005/0000663 | A1 * | 1/2005 | Nien | 160/168.1 R |
| 2008/0023157 | A1 * | 1/2008 | Ganzi | 160/176.1 R |
| 2010/0269987 | A1 * | 10/2010 | Martin et al. | 160/309 |
| 2011/0186246 | A1 * | 8/2011 | Lin | 160/309 |
| 2011/0203742 | A1 * | 8/2011 | Lin | 160/121.1 |
| 2011/0259533 | A1 * | 10/2011 | Lin | 160/340 |
| 2012/0273142 | A1 * | 11/2012 | Miller et al. | 160/309 |
| 2013/0220561 | A1 * | 8/2013 | Yu et al. | 160/340 |
| 2013/0340951 | A1 * | 12/2013 | Yu et al. | 160/168.1 P |

FOREIGN PATENT DOCUMENTS

| | | | | |
|---|---|---|---|---|
| EP | 1422377 | A1 * | 5/2004 | E06B 9/304 |
| EP | 1500777 | A1 * | 1/2005 | E06B 9/76 |
| EP | 2363569 | A1 * | 9/2011 | |
| WO | WO 2012093092 | A1 * | 7/2012 | |

* cited by examiner

WINDOW BLIND

BACKGROUND OF THE INVENTION

1. Field of the Invention

The invention relates to a window blind, more particularly to a cordless window blind.

2. Description of the Related Art

As shown in FIGS. 1 and 2, a conventional cordless window blind 1 is disclosed to include a stationary seat 11 fixedly mounted over a top of a window, a blind mechanism 12 connected releasably to the stationary seat 11, a control pole 10, a coupling mechanism 13 connected to the control pole 10 and the blind mechanism 12, and an anti-rotation seat 14 fixedly mounted on a wall surface below the window and formed with an engaging groove 141.

The blind mechanism 12 includes a blind member 121 having one end that is connected to the stationary seat 11, a linking rod 122 mounted rotatably to the stationary seat 11, a sheet member 123 having one end that is connected to the linking rod 122 and wound releasably thereon, and a plurality of spaced-apart connecting members 124 interconnecting the blind member 121 and the sheet member 123. The coupling mechanism 13 includes a first gear 131 connected co-rotatably to the control pole 10, and a second gear 132 connected co-rotatably to the linking rod 122 and meshing with the first gear 131. The control pole 10 has an anti-rotation segment 101 that is engageable with the anti-rotation seat 14 for preventing the control pole 10 from rotating.

When the control pole 10 is rotated, the linking rod 122 rotates via transmission between the first gear 131 and the second gear 132 of the coupling mechanism 13 and can retract the sheet member 123 and the blind member 121. When the blind member 121 is moved to a desired position, the anti-rotation segment 101 of the control pole 10 is engaged to the engaging groove 141 of the anti-rotation seat 14 for stopping the rotation of the control pole 10 and retaining the desired position of the blind member 121. If the blind member 121 needs to be released afterward, the anti-rotation segment 101 of the control pole 10 is disengaged from the engaging groove 141 of the anti-rotation seat 14 so as to permit the rotation of the control pole 10, and the blind member 121 would be automatically released due to the weight thereof.

However, the engagement and disengagement between the control pole 10 and the anti-rotation seat 14 have to be performed by a user close to the wall surface, thereby causing inconvenience to the user. Besides, due to the weight of the blind mechanism 12, at the moment of disengaging the control pole 10 from the anti-rotation seat 14, the sheet member 123 and the blind member 121 may suddenly be released, thereby causing difficulty for positioning the blind member 121 of the blind mechanism 12 before the release or retraction of the blind member 121.

SUMMARY OF THE INVENTION

Therefore, the object of the present invention is to provide a window blind that is convenient to operate.

Accordingly, a window blind of the present invention includes:

a stationary seat;

a blind mechanism including a linking rod that is mounted rotatably to the stationary seat, and a blind unit wound releasably on the linking rod;

a coupling mechanism including a transmission unit that is connected to the linking rod, and that is movable between an operable state, where the linking rod is permitted to rotate for releasing or retracting the blind unit, and a non-operable state, where rotation of the linking rod is not permitted, a stop unit that is disposed for restraining rotation of the linking rod when the transmission unit is at the non-operable state, and a resilient member that is disposed for biasing the transmission unit toward the non-operable state; and a control pole connected to the transmission unit and operable for converting the transmission unit to the operable state against a resilient force of the resilient member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
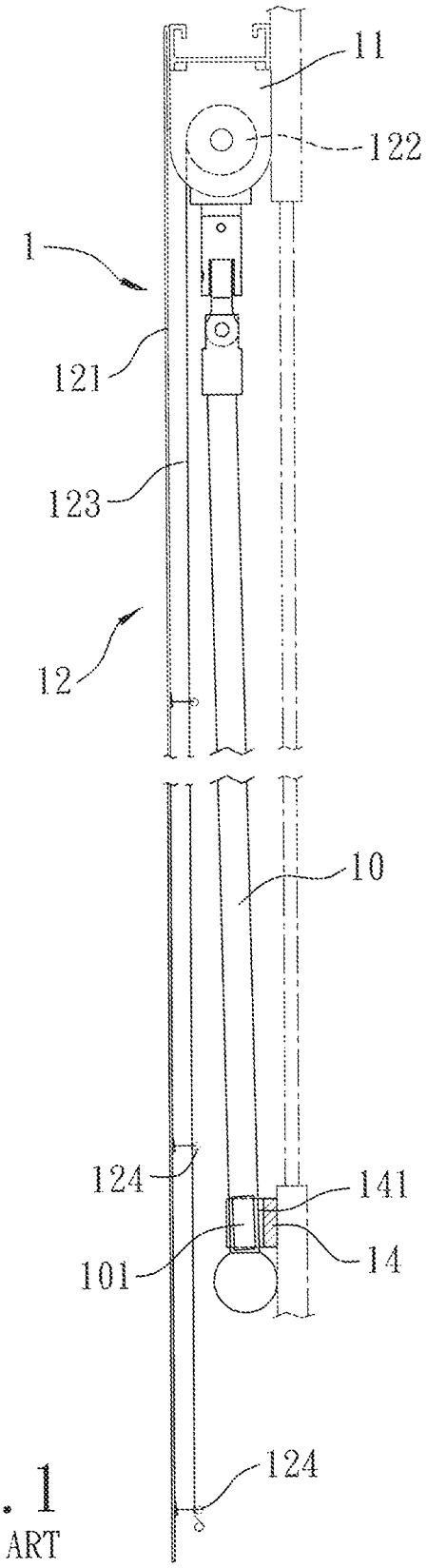
FIG. 1 PRIOR ART
FIG. 1 is a fragmentary partly sectional view of a conventional window blind.
Figure 2:
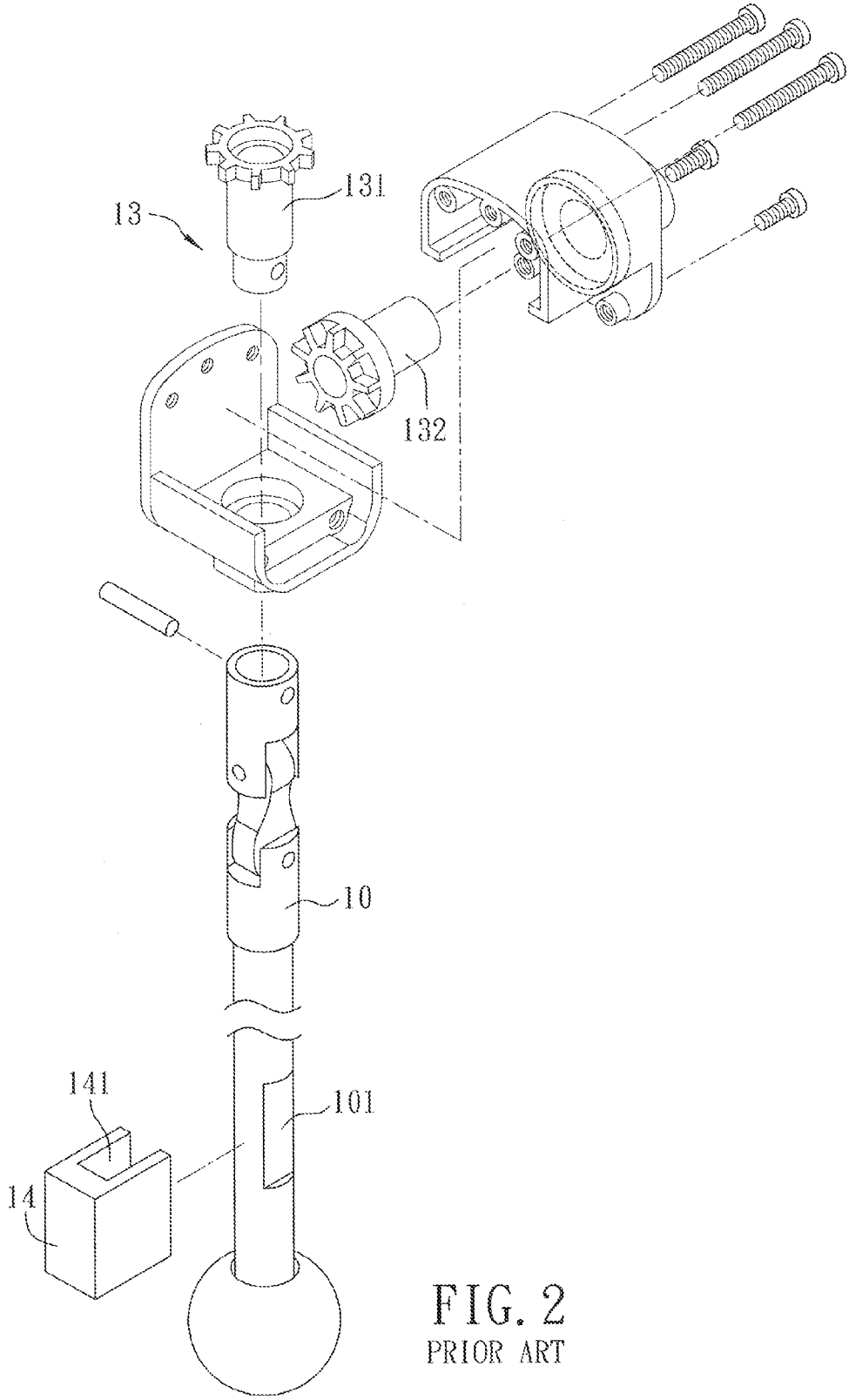
FIG. 2 PRIOR ART
FIG. 2 is a fragmentary exploded perspective view of a control pole, a coupling mechanism and an anti-rotation seat of the conventional window blind.

Before the present invention is described in greater detail, it should be noted that like elements are denoted by the same reference numerals throughout the disclosure.

Figure 3:
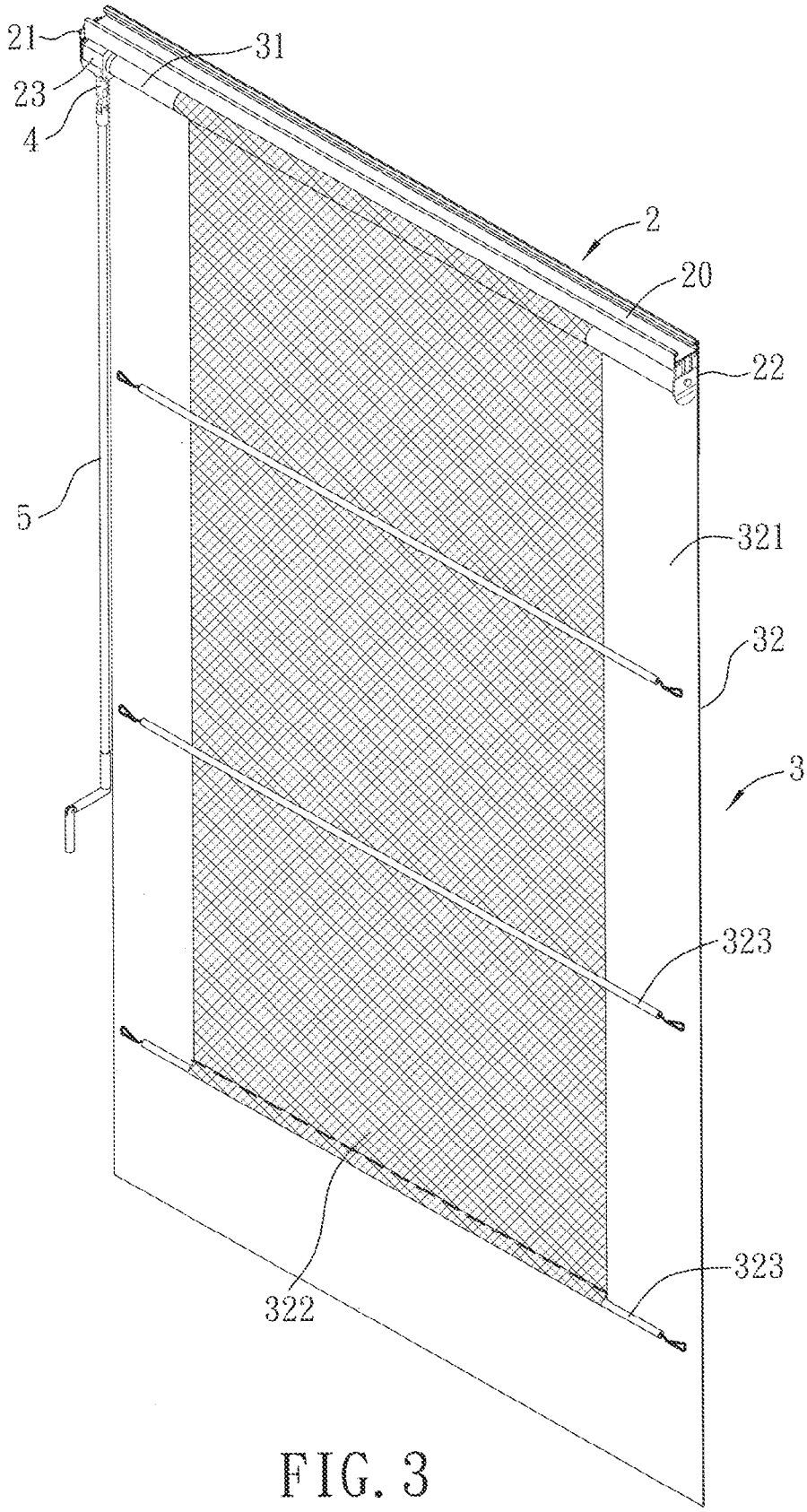
FIG. 3 is a perspective view of a first preferred embodiment of a window blind according to the present invention.
Figure 4:
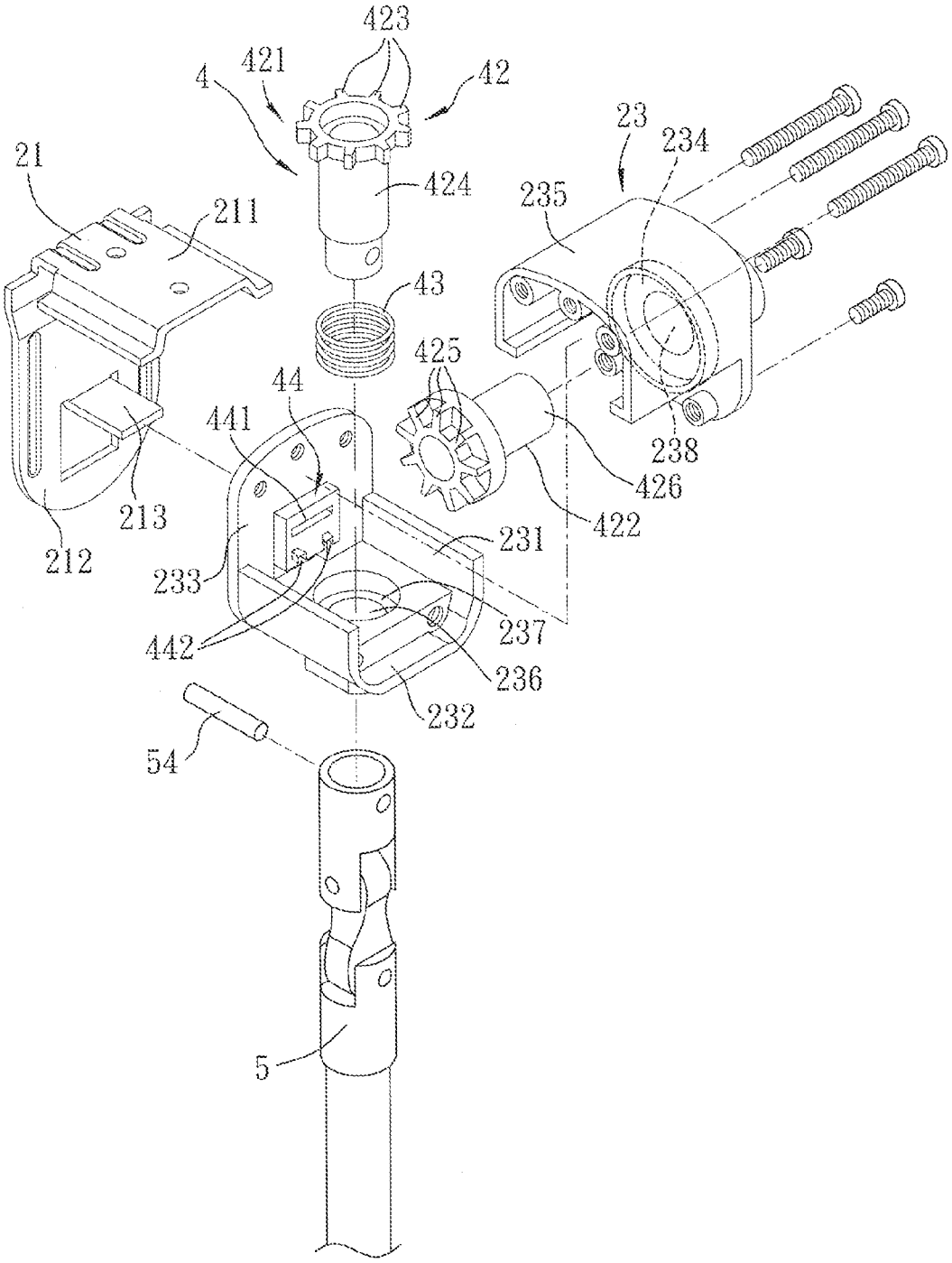
FIG. 4 is a fragmentary exploded perspective view of a stationary seat, a coupling mechanism and a control pole of the first preferred embodiment of the window blind.
Figure 5:
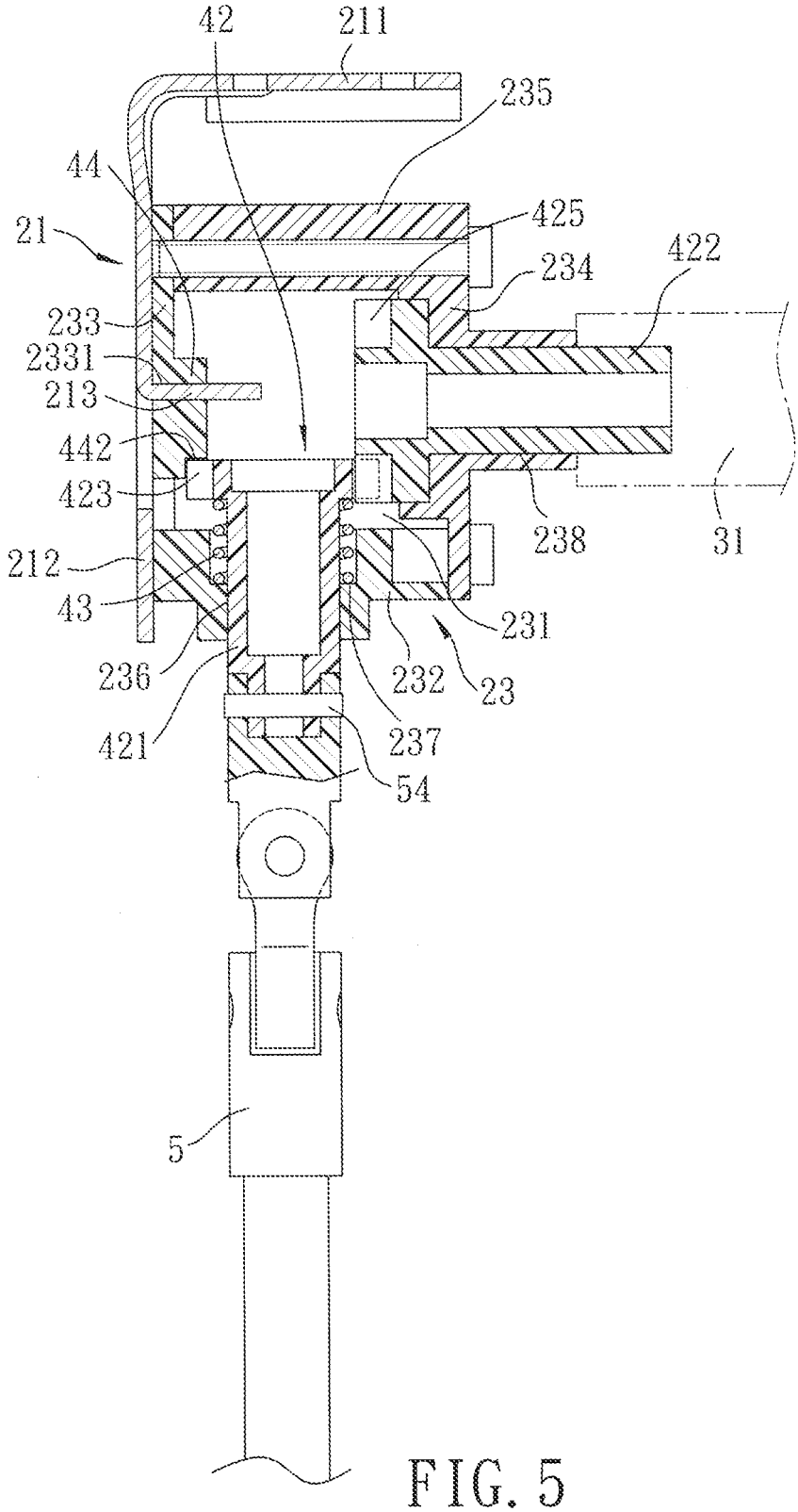
FIG. 5 is a fragmentary partly sectional view of the first preferred embodiment, illustrating a transmission unit of the coupling mechanism at a non-operable state.

As shown in FIGS. 3, 4, and 5, a first preferred embodiment of a window blind according to the present invention includes a stationary seat 2 adapted to be mounted on a wall surface over a top of a window (not shown), a blind mechanism 3, a coupling mechanism 4, and a control pole 5.

The stationary seat 2 includes a roof 20 extending in a longitudinal direction and having opposite ends in the longitudinal direction, a first edge that is coupled to the wall surface and a second edge that is opposite to the first edge in a transverse direction that is transverse to the longitudinal direction, first and second end walls 21, 22 connected respectively to the opposite ends of the roof 20, and a housing 23 disposed between the first and second end walls 21, 22 and connected to the first end wall 21. The first end wall 21 has a securing portion 211 secured to the roof 20, a suspending portion 212 extended downwardly from the securing portion 211, and an inserting portion 213 disposed under the securing portion 211 and extending in the longitudinal direction from the suspending portion 212.

The housing 23 includes two housing pieces coupled together, and has an outer wall 233, a U-shaped base wall 232 extending in the longitudinal direction from a bottom of the outer wall 233 and cooperating with the outer wall 233 to define one of the housing pieces, an inner wall 234 connected to a distal edge of the base wall 232, and an inverted U-shaped upper wall 235 cooperating with the inner wall 234 to define the other one of the housing pieces and connected to the outer wall 233, the inner wall 234, and the base wall 232. The housing 23 defines a gear-receiving space 231 therein for receiving the coupling mechanism 4. The outer wall 233 is formed with a first slot 2331 (see FIG. 5), and the outer wall 233 is coupled to the first end wall 21 with the inserting portion 213 of the first end wall 21 extending through the first slot 2331. The base wall 232 of the housing 23 is formed with a first hole 236, and the inner wall 234 is formed with a second hole 238.

The blind mechanism 3 includes a hollow linking rod 31 that has opposite ends mounted rotatably and respectively to the housing 23 and the second end wall 22 of the stationary seat 2, and a blind unit 32 wound releasably on the linking rod 31. The blind unit 32 includes a blind member 321 having one end connected to the first edge of the roof 20 of the stationary seat 2, a sheet member 322 wound releasably on the linking rod 31, and a plurality of spaced-apart connecting members 323 interconnecting the blind member 321 and the sheet member 322. In this embodiment, each of the connecting members 323 is configured as a rod. Accordingly, rotation of the linking rod 31 drives the sheet member 322 to be released or retracted, thereby also releasing or retracting the blind member 321 via the connecting members 323. It should be noted that, in other embodiments of the present invention, the blind member 321 may be wound releasably on the linking rod 31 together with the sheet member 322 instead of being connected directly to the roof 20.

The coupling mechanism 4 includes a transmission unit 42, a resilient member 43, and a stop unit 44. The transmission unit 42 is received in the gear-receiving space 231, is connected to the linking rod 31, and is movable between an operable state (see FIG. 7), where the linking rod 31 is permitted to rotate for releasing or retracting the sheet member 322, and a non-operable state (see FIGS. 5 and 6), where rotation of the linking rod 31 is not permitted.

The transmission unit 42 includes a first gear 421 and a second gear 422. The first gear 421 has a plurality of angularly spaced-apart first gear teeth 423 disposed in the gear-receiving space 231, and a connecting portion 424 extending downwardly through the first hole 236 and connected co-rotatably to the control pole 5. The second gear 422 has a plurality of angularly spaced-apart second gear teeth 425 meshing with the first teeth 423 of the first gear 421, and a coupling portion 426 that extends in the longitudinal direction through the second hole 238 and that is inserted fittingly into the linking rod 31 so as to be co-rotatable with the linking rod 31.

The base wall 232 of the housing 3 has an annular shoulder portion 237 formed in the first hole 236. In this embodiment, the resilient member 43 is a compression spring having opposite ends that abut respectively against the first gear teeth 423 of the first gear 421 and the shoulder portion 237 for biasing the first gear 421 upwardly. The stop unit 44 is formed with a second slot 441 registered with the first slot 2331 of the outer wall 233 of the housing 23, and at least one engaging groove 442 opening downwardly and engageable with at least one of the first teeth 423 of the first gear 421. In this preferred embodiment, two engaging grooves 442 are formed. The inserting portion 213 of the first end wall 21 extends through the first slot 2331 and the second slot 441 for strengthening the coupling between the housing 3 and the first end wall 21.

Figure 6:
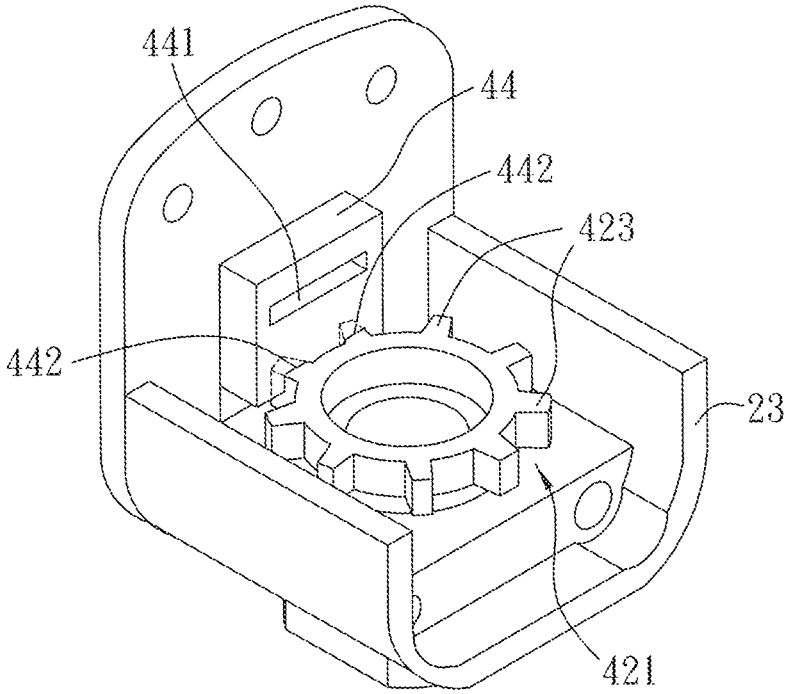
FIG. 6 is a perspective view of a first gear of the transmission unit engaging a stop unit when the transmission unit is at the non-operable state.

As shown in FIGS. 3, 5, and 6, when the transmission unit 42 of the first embodiment is at the non-operable state, the first gear 421 is biased upwardly by the resilient member 43 such that two of the first teeth 423 are engaged with the engaging grooves 442 respectively, while the first teeth 423 still mesh with the second teeth 425. Such engagement between the first teeth 423 and the engaging grooves 442 restrains rotations of the first gear 421, the second gear 422 and the linking rod 31. Therefore, the blind unit 32 can be positioned at a desired state.

Figure 7:
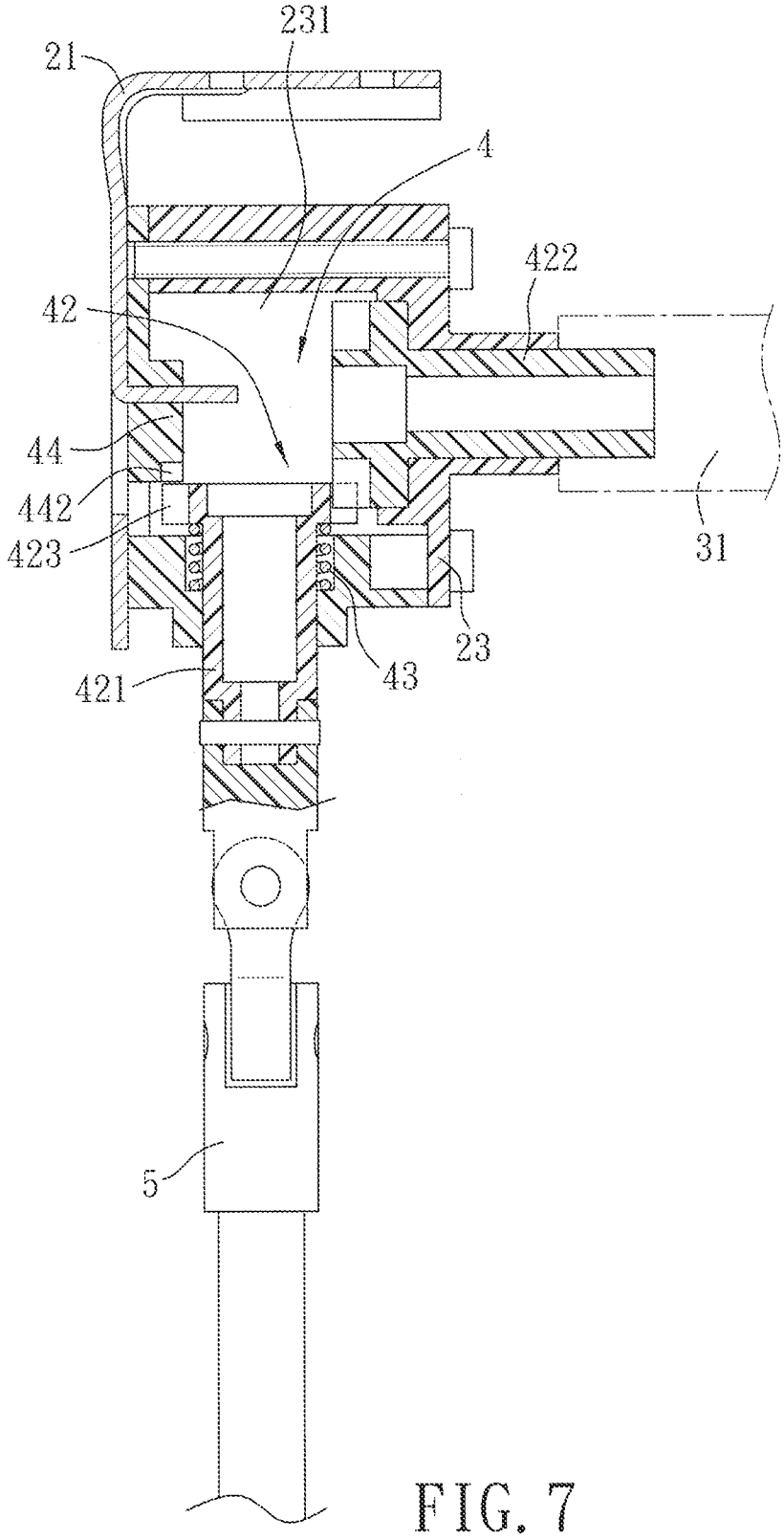
FIG. 7 is another fragmentary partly sectional view of the first preferred embodiment, illustrating the transmission unit at an operable state.

As shown in FIGS. 3 and 7, when the blind member 321 needs to be released or retracted, the control pole 5 is pulled downwardly by a user to overcome the resilient force of the resilient member 43, thereby disengaging the two of the first gear teeth 423 from the engaging grooves 442 and converting the transmission unit 42 to the operable state. At this time, the control pole 5 and the first gear 421 are permitted to rotate, thereby driving rotation of the linking rod 31 via the engagement between the first and second gears 421, 422 to release or retract the blind member 321.

To stop the movement of the blind member 321, the user only needs to release the control pole 5 so that the resilient member 43 biases the first gear 421 to move upwardly to convert the transmission unit 42 back to the non-operable state. Therefore, by virtue of the coupling mechanism 4, the window blind of the present invention is easy to operate. Moreover, since the user must hold the control pole 5 tightly for exerting a force against the resilient force of the resilient member 43 when disengaging the two of the first teeth 423 from the engaging grooves 442, sudden fall of the blind member 321 can be effectively alleviated.

Figure 8:
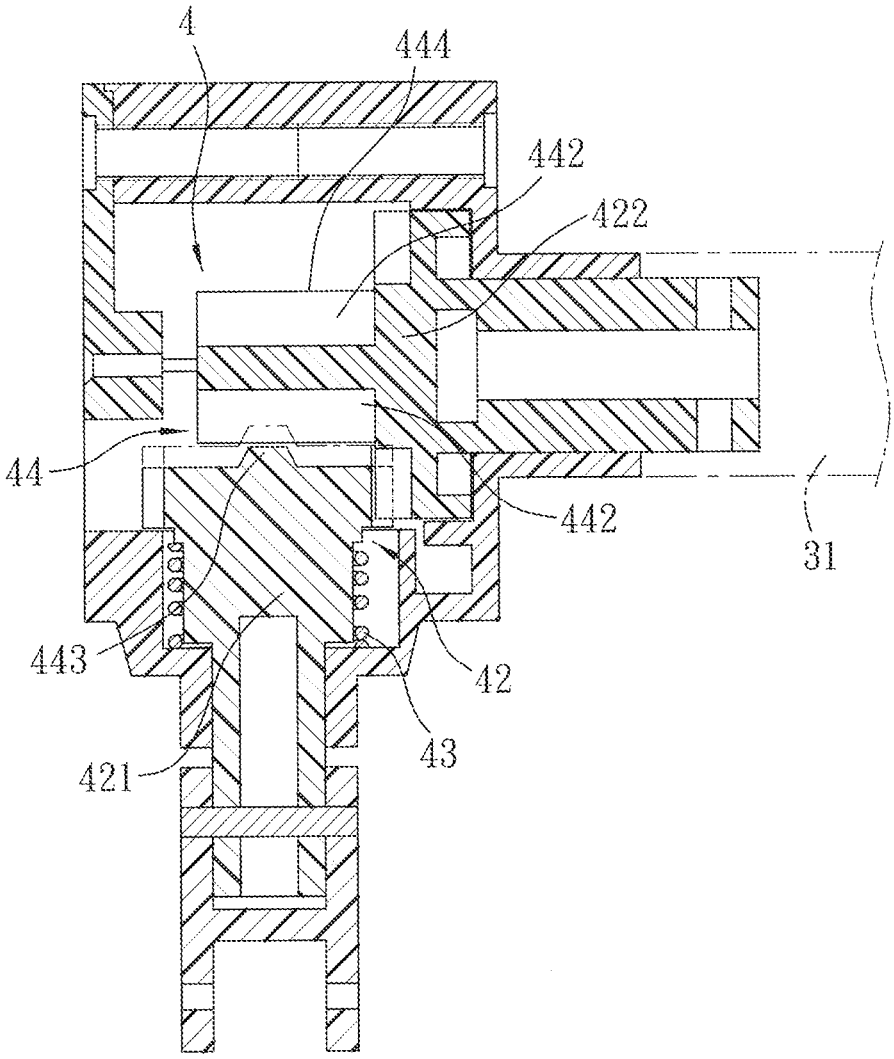
FIG. 8 is a fragmentary partly sectional view of a second preferred embodiment of the window blind according to the present invention.
Figure 9:
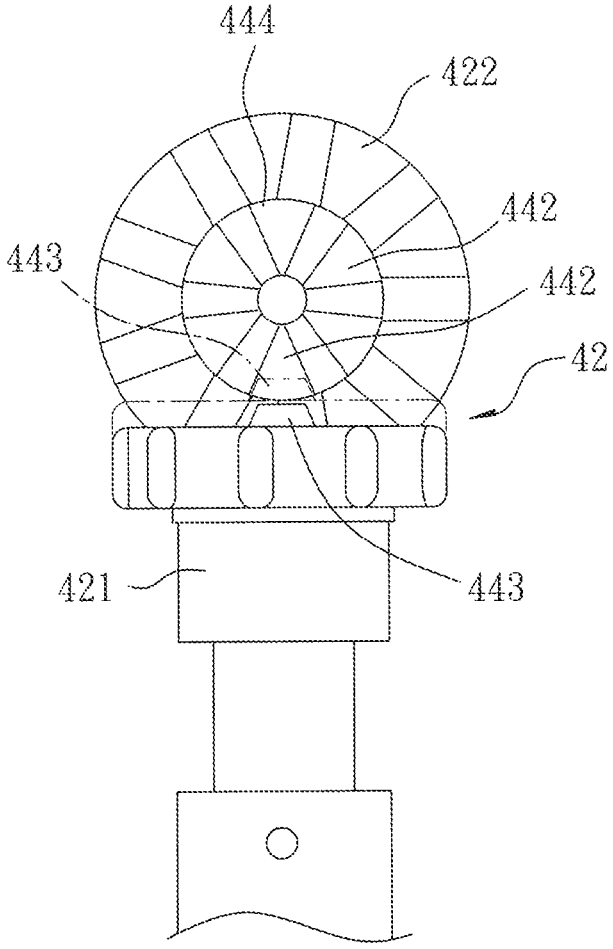
FIG. 9 is a fragmentary side view of first and second gears of the transmission unit and a stop unit of the second preferred embodiment.

As shown in FIGS. 8 and 9, the second preferred embodiment of the window blind according to the present invention has a structure similar to that of the first embodiment. The main difference between this embodiment and the previous embodiment resides in the configuration of the stop unit 44 of the coupling mechanism 4. The stop unit 44 in this second preferred embodiment has an engaging protrusion 443 formed on the first gear 421 of the transmission unit 42, and an engaging rod 444 extending from the second gear 422 in the longitudinal direction and formed with a plurality of angularly spaced-apart engaging grooves 442. The first gear 421 is biased upwardly by the resilient member 43 and the engaging protrusion 443 engages one of the engaging grooves 442 when the transmission unit 42 is at the non-operable state. The second preferred embodiment has the same advantages as those of the first preferred embodiment.

Figure 10:
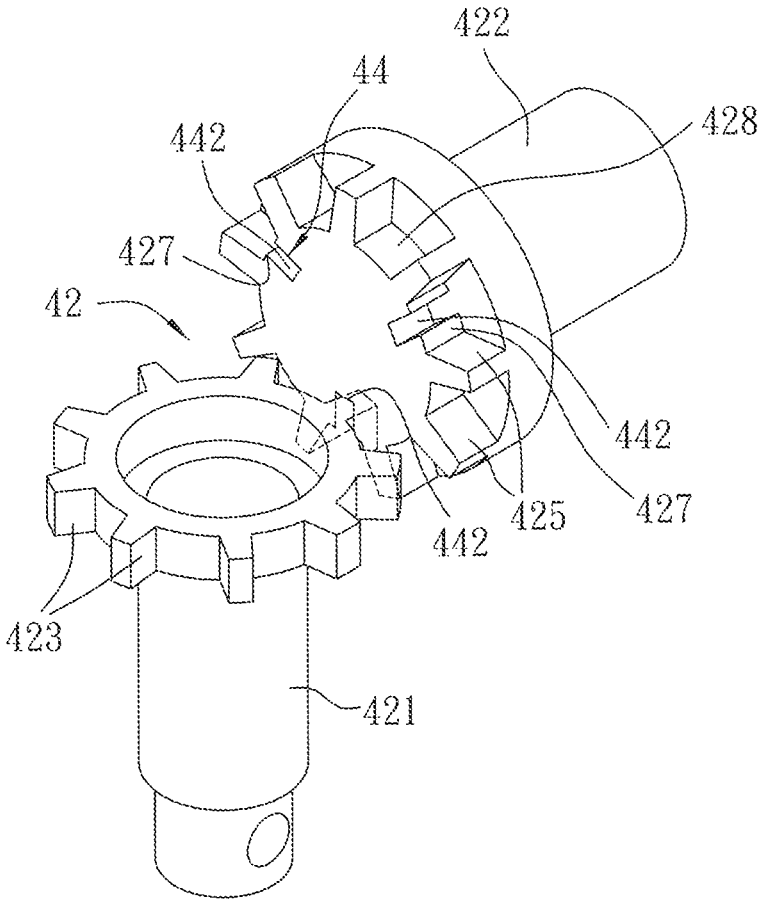
FIG. 10 is a perspective view of first and second gears of the transmission unit and a stop unit of a third preferred embodiment of the window blind according to the present invention.
Figure 11:
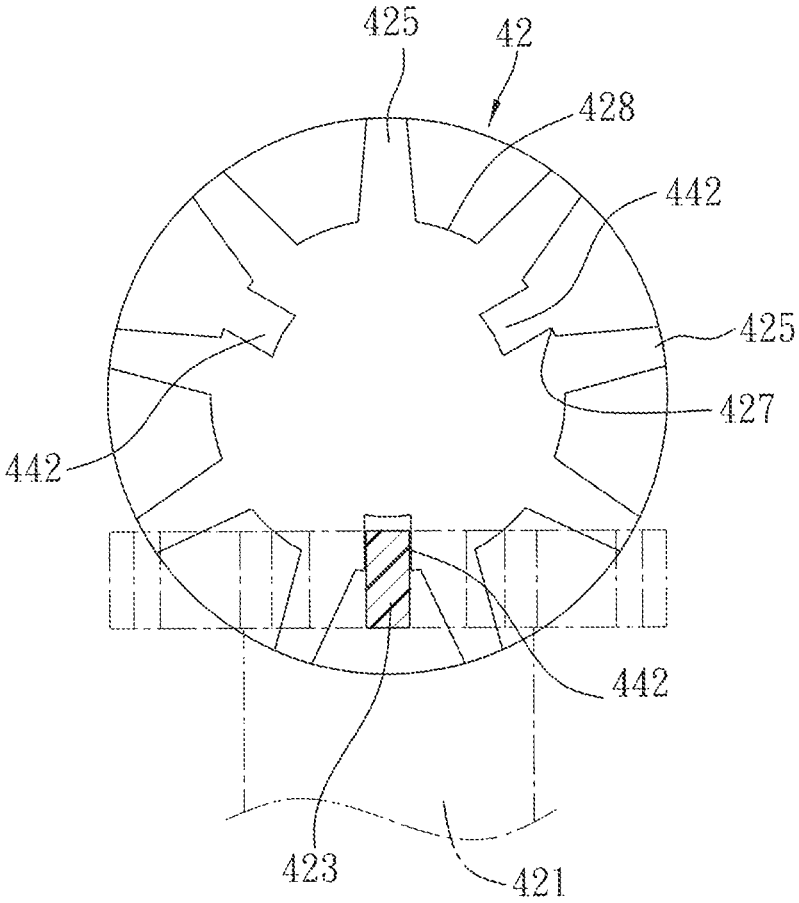
FIG. 11 is a sectional view of the first and second gears of the transmission unit and the stop unit of the third preferred embodiment of the window blind.

As shown in FIGS. 10 and 11, the third preferred embodiment of the window blind according to the present invention has a structure similar to that of the first preferred embodiment. The main difference between this embodiment and the first preferred embodiment resides in the following. The stop unit 44 of the coupling mechanism 4 is formed on the second gear 422 of the transmission unit 42. Specifically, the second gear 422 has a plurality of first bottom lands 427 and a plurality of second bottom lands 428. Each of the first and second bottom lands 427, 428 is formed between an adjacent pair of the second gear teeth 425. The second gear 422 further has a plurality of engaging grooves 442 formed respectively in the first bottom lands 427. When the transmission unit 42 is at the non-operable state, one of the first teeth 423 of the first gear 421 engages one of the engaging grooves 442 due to the resilient force of the resilient member 43. The third preferred embodiment has the same advantages as those of the first preferred embodiment.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A window blind comprising:

a stationary seat;

a blind mechanism including a linking rod that is mounted rotatable to said stationary seat, and a blind unit wound releasably on said linking rod;

a coupling mechanism including a transmission unit that is connected to said linking rod, and that is movable between an operable state, where said linking rod is permitted to rotate for releasing or retracting said blind unit, and a non-operable state, where rotation of said linking rod is not permitted, a stop unit that is disposed for restraining rotation of said linking rod when said transmission unit is at the non-operable state, and a resilient member that is disposed for biasing said transmission unit toward the non-operable state; and a control pole connected to said transmission unit and operable for converting said transmission unit to the operable state against a resilient force of said resilient member;

wherein said transmission unit includes a first gear that is connected co-movably to said control pole and that has a plurality of angularly spaced-apart first gear teeth, and a second gear that is connected co-rotatably to said linking rod and that has a plurality of angularly spaced-apart second gear teeth meshing with said first gear teeth of said first gear;

wherein said second gear has a plurality of first and second bottom lands, each of which is formed between an adjacent pair of said second gear teeth, said stop unit having a plurality of engaging grooves formed respectively in said first bottom lands of said second gear, one of said first teeth of said first gear engaging one of said engaging grooves when said transmission unit is at the non-operable state, a number of said engaging grooves being less than a number of said second gear teeth of said second gear.

2. The window blind as claimed in claim 1, wherein said blind unit of said blind mechanism includes a blind member having one end connected to said stationary seat, a sheet member wound releasably on said linking rod, and a plurality of spaced-apart connecting members interconnecting said blind member and said sheet member.

3. A window blind comprising:

a stationary seat;

a blind mechanism including a linking rod that is mounted rotatably to said stationary seat, and a blind unit wound releasably on said linking rod;

a coupling mechanism including a transmission unit that is connected to said linking rod, and that is movable between an operable state, where said linking rod is permitted to rotate for releasing or retracting said blind unit, and a non-operable state, where rotation of said linking rod is not permitted, a stop unit that is disposed for restraining rotation of said linking rod when said transmission unit is at the non-operable state, and a resilient member that is disposed for biasing said transmission unit toward the non-operable state; and a control pole connected to said transmission unit and operable for converting said transmission unit to the operable state against a resilient force of said resilient member;

wherein said transmission unit includes a first gear that is connected co-movably to said control pole and that has a plurality of angularly spaced-apart first gear teeth, and a second gear that is connected co-rotatably to said linking rod and that has a plurality of angularly spaced-apart second gear teeth meshing with said first gear teeth of said first gear;

wherein said stop unit has an engaging protrusion formed on said first gear, and an engaging rod extending from said second gear and formed with a plurality of engaging grooves, said engaging protrusion engaging one of said engaging grooves when said transmission unit is at the non-operable state.

4. The window blind as claimed in claim 3, wherein said blind unit of said blind mechanism includes a blind member having one end connected to said stationary seat, a sheet member wound releasably on said linking rod, and a plurality of spaced-apart connecting members interconnecting said blind member and said sheet member.

* * * * *